United States Patent [19]

Santi et al.

[11] 4,168,808

[45] Sep. 25, 1979

[54] COIL WINDING MACHINE WITH INSULATION SHEET TENSIONING MECHANISM

[75] Inventors: John D. Santi, Milwaukee, Wis.; Henry A. Hawken, Granby, Conn.

[73] Assignee: Briggs & Stratton Corporation, Wauwatosa, Wis.

[21] Appl. No.: 772,553

[22] Filed: Feb. 28, 1977

[51] Int. Cl.[2] ..... H01F 41/12

[52] U.S. Cl. ..... 242/7.08; 156/446

[58] Field of Search ..... 242/7.08, 56.1; 156/171, 432, 431, 430, 429, 446

[56] References Cited

U.S. PATENT DOCUMENTS

| | | | |
|---|---|---|---|
| 2,257,837 | 10/1941 | Burge et al. | 242/7.08 |
| 2,688,450 | 9/1954 | Bell | 242/7.08 |
| 3,970,259 | 7/1976 | Schmid | 242/7.08 |
| 3,985,311 | 10/1976 | Stuart | 242/7.08 |

*Primary Examiner*—Billy S. Taylor

*Attorney, Agent, or Firm*—Ira Milton Jones

[57] ABSTRACT

An automatic coil winding machine having mechanism for automatically emplacing a sheet of insulating material upon completion of the winding of each layer of turns, as disclosed in U.S. Pat. No. 2,688,450, is improved to effect tight winding of the sheets. A row of resilient spring fingers is mounted on the sheet delivering element of the machine. When that element is in its forward, sheet-delivering position, a localized surface portion of each finger engages under bias against the coil form, to impose a slight drag on the sheet being wound, said surfaces being located to first engage the sheet after about half a turn of its wrap around the coil form. When the sheet delivering element is in its rearward position, the fingers are spaced from the coil form.

3 Claims, 3 Drawing Figures

Figure 1:
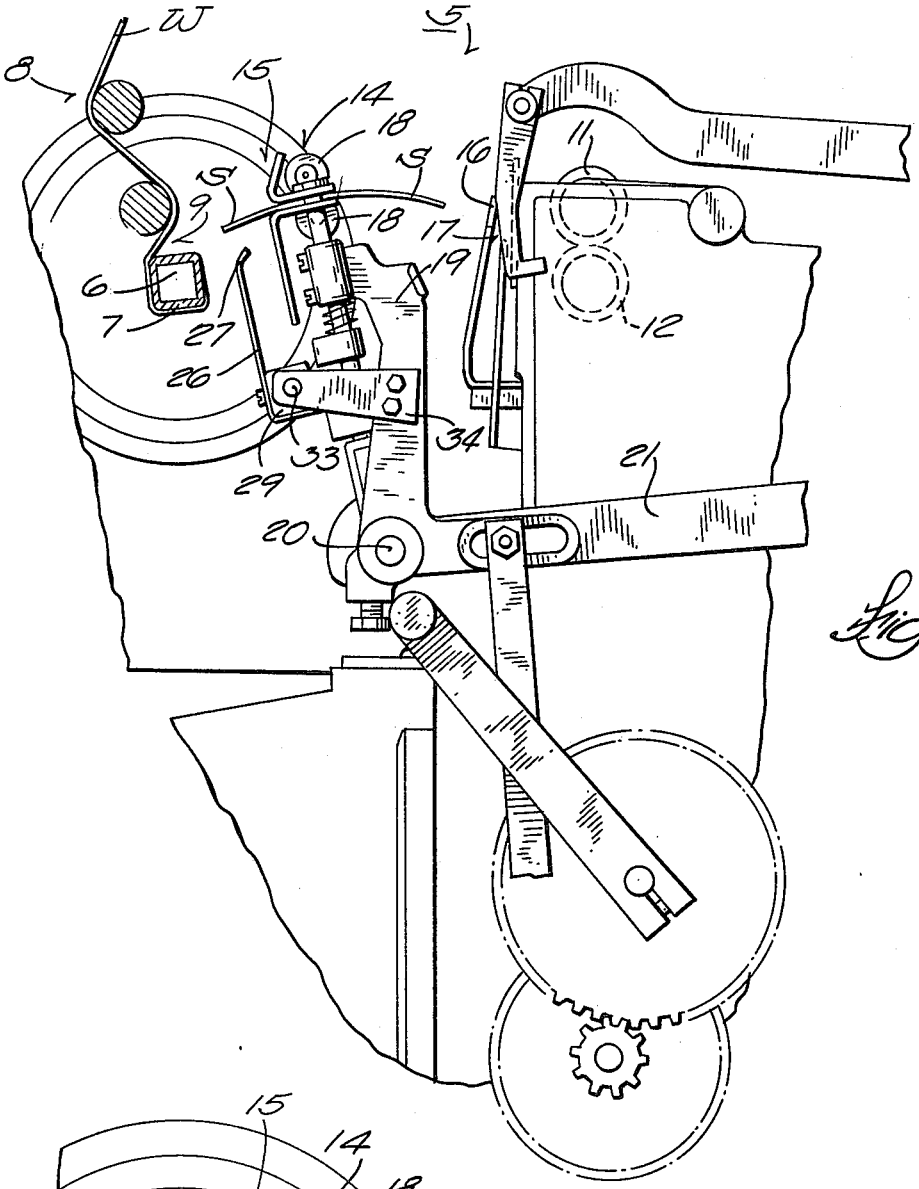

W
W
9
9
27
27
7
26
26
29
30
30
35
33
31
31
34

COIL WINDING MACHINE WITH INSULATION SHEET TENSIONING MECHANISM

This invention relates to automatic coil winding machines of the type having automatic sheet emplacing mechanism whereby a sheet of paper or similar insulation material is wrapped around each layer of turns of a coil being wound, to separate adjacent wound layers in the finished coil; and the invention is more particularly concerned with automatic means in such a machine for ensuring that each sheet of insulation material is tightly wrapped, so that a coil wound on the machine will be compact, firm and stable.

A coil winding machine of the general type to which the invention relates comprises a rotatable mandrel or chuck upon which a tubular coil form can be readily removably mounted for coaxial rotation with the chuck or mandrel. The coil form is rather long, and several coils are usually wound onto it simultaneously, at axially spaced locations, to form a so-called stick of coils. Following the winding operation, the coil form is cut transversely between adjacent coils to separate the same from one another. Each coil is of course wound with an individual strand of wire that is drawn off of a bobbin or the like by the rotation of the coil form. The several bobbins are mounted on the machine for substantially free rotation at locations spaced from the mandrel or chuck.

As the coil form turns, a wire guide located fairly close to it so guides each of the several strands of wire onto the coil form as to lay the wire in a smooth layer of closely adjacent turns. The wire guide is reciprocated parallel to the mandrel axis in synchronization with rotation of the mandrel, so that each layer of each coil has a predetermined number of turns and the several layers of a coil accurately overlie one another.

At each point of reversal of wire guide travel, and while the coil form continues to rotate, a sheet of paper or paper-like insulating material is automatically fed between the coil form and the several strands of wire being wound onto it. The continuing rotation of the coil form rolls the sheet around it, to interpose the sheet between the layer of wire that has just been wound and the one being wound over it. Each sheet thus serves as an insulation between adjacent layers of turns.

The mechanism employed in one widely used coil winding machine for automatically feeding insulation sheets onto the coil form is disclosed in detail in U.S. Pat. No. 2,688,450, issued in 1954 to C. C. Bell. Insulation paper is supplied to that machine in a continuous strip, on a supply roll that is mounted for substantially free rotation at some distance from the rotating coil form. The strip is drawn off of the supply roll by opposed feed rollers, and they feed the strip into the clamping bite of a delivery element that is movable back and forth between the feed rollers and the coil form. Automatically operating measuring and cutting mechanism, located between the feed rollers and the delivery element and synchronized with the wire guide, makes transverse cuts across the strip to separate it into individual sheets, each of a size to be wrapped once around the coil form.

The strands of wire being wound onto the coil form are all initially attached thereto at one side of its axis, which can be regarded as the front side, the coil form generally being polygonal in cross section and usually square. The path of back-and-forth movement of the delivery element is located wholly to the rear of the coil form axis. As the winding of a layer of turns is being completed, the delivery element makes a forward traverse with a sheet of paper clamped in it. Just before the next layer of turns is begun a marginal edge portion of the sheet that projects a substantial distance forwardly from the delivery element is carried across the top of the coil form and into the V defined by the surface of the just wound layer of turns and the several strands of wire leading from the last turns thereof. The oncoming wire strands thus coact with the rotating coil form to grip the leading edge portion of the sheet, wind it onto the just wound layer of turns, and thus draw it from the delivery element.

While the sheet is being drawn from the delivery element, opposed, freely rotating rollers on the delivery element afford a certain amount of guidance to the sheet to prevent it from being wrinkled, buckled or skewed as it is being wound onto the coils. But the rollers on the delivery element cannot ensure a tight wrapping of the sheet around the coils.

Obtaining a snug, tight wrap of every insulation sheet is a long-sought objective with small machine-wound coils. Obviously a coil that has snugly wrapped insulation will occupy less space than one that does not, and coil space is often at a premium. Furthermore, a coil with loosely wrapped insulation requires very careful handling because its wire layers are not adequately held against axial displacement, and it can literally fall apart if its layers are not confined against such sliding.

Heretofore the only expedient for obtaining a reasonably snug wrapping of insulation sheets has been to impede rotation of the wire supply bobbins to some extent, in order to tension the wire strands being wound onto the coil form. Each insulation sheet would than be forced more or less firmly down onto its underlying layer of wire by the radially inward force of the tensioned wires being wound onto the form.

If the coils were being wound with fairly heavy wire, such tensioning of the wires was possible, although it was not a fully satisfactory expedient for obtaining tight winding of insulation. But for coils wound with fine wire it could only be described as hopelessly unsatisfactory. The wire used for magneto and ignition coil secondaries, and for high impedance relay windings and the like, has very little strength in tension. It can usually sustain enough pull to be wound onto a coil form in an adequately smooth and snug layer, but all too often it cannot support the additional tension imposed upon it by relatively stiff insulation paper that tries to spring away from the surface of its underlying winding layer. The resultant wire breakage is of course expensive in time and material as well as being annoying.

During the twenty or more years that machines embodying the invention of U.S. Pat. No. 2,688,450 have been in commercial use, various attempts have been made to achieve tight wrapping of the insulation sheets on coils wound with such machines. To take advantage of wire tension but minimize wire breakage, the use of relatively thin supple paper has been proposed. One fault in this proposal is pointed out in U.S. Pat. No. 2,925,014, issued in February, 1960 to W. V. Goodhue et al: "The insulating material inserted by the winding machine disclosed in said U.S. Pat. No. 2,688,450 is normally extremely thin and difficult to handle and occasionally it becomes wrinkled or torn, or otherwise affected, so that the paper measuring and delivering part of the mechanism can not function properly and resulting in the omission of one or more layers of insulation." The Goodhue et al patent proposes a detection apparatus by which the winding machine is stopped when a sheet of paper is not properly inserted into the winding. This eliminates one source of annoyance by replacing it with a less objectionable one. But it still fails to overcome another and very serious objection to the use of thin paper. Even when such paper is properly inserted and tightly wound, it is functionally unsatisfactory because thin paper naturally possesses low dielectric strength.

To obtain the necessary insulation value, it was proposed to insert two flatwise superimposed sheets of thin paper between each pair of wound layers, but this involved mechanical complications for emplacement of the double-thickness sheets and still did not promise to provide a really tight wrapping.

It was also proposed to moisten the paper as it was being applied, in the hope that the paper would shrink as it dried and thus provide the firm, tight coils that were desired. This proposal was obviously somewhat impractical because it raised a new set of problems in the effort to solve the existing one, but the very fact that it was brought forward is evidence of the urgency of the problem of loose, spongy windings.

The present invention solves this long-standing problem without giving rise to any new ones.

Thus, the general object of the present invention is to provide means in a coil winding machine of the character described for ensuring that relatively thick sheets of paper or similar insulation, having the requisite dielectric strength, will be snugly wound between the successive layers of the coils, to produce coils that are firm, compact and stable, without the need for moistening the sheet insulation material or otherwise subjecting it to unusual treatment, and without the need for imposing any more tension upon the wire strands than is needed to achieve smooth, tight layers.

More specifically, it is an object of this invention to provide, in a coil winding machine of the character described, very simple and inexpensive but fully automatic means for causing every insulation sheet to be very tightly wound onto the coil, said means being one that does not slow down the operation of the machine or complicate its timing or actuating mechanisms in any manner and does not present any inconvenience to an attendant performing the various manual operations that are incidental to use of the machine.

Another specific object of the invention is to provide a device that can be very readily installed on many existing automatic coil winding machines of the character described, to adapt them for producing firm, stable coils that have very tightly wound insulation sheets between their layers of wire, said device being mounted on a movable element of such a machine, to be timed and actuated by the same mechanism—entirely unmodified—that times and actuates said movable element.

It is also a specific object of this invention to provide means for reducing the frequency of wire breakages encountered when an automatic coil winding machine is operated with fine wire, while at the same time achieving a tight, snug wrapping of insulation sheets as stated above.

These objectives are achieved by equipping the coil winding machine with a plurality of resilient fingers, each of which has a localized sheet-engaging surface portion, the fingers being mounted on a common carrier with their said surface portions spaced therefrom and arranged in a straight row, the common carrier being so mounted in the machine that the straight row of said surface portions of the fingers is parallel with the axis of the mandrel by which coil forms are held and rotated, the common carrier being movable between a defined inoperative position in which the fingers are spaced a substantial distance from the mandrel and an operative position in which their localized surface portions bear against a sheet of insulation material being wound onto a coil rotating with the mandrel; and the common carrier being successively moved back and forth between its defined positions in such timed relation with the sheet feeding instrumentalities of the machine that during the time interval a sheet of insulation is being wrapped around the coil, the fingers clamp the sheet against the coil and impose sufficient resistance to the advance of the sheet as to assure its being tightly wrapped onto the coil.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

Figure 2:
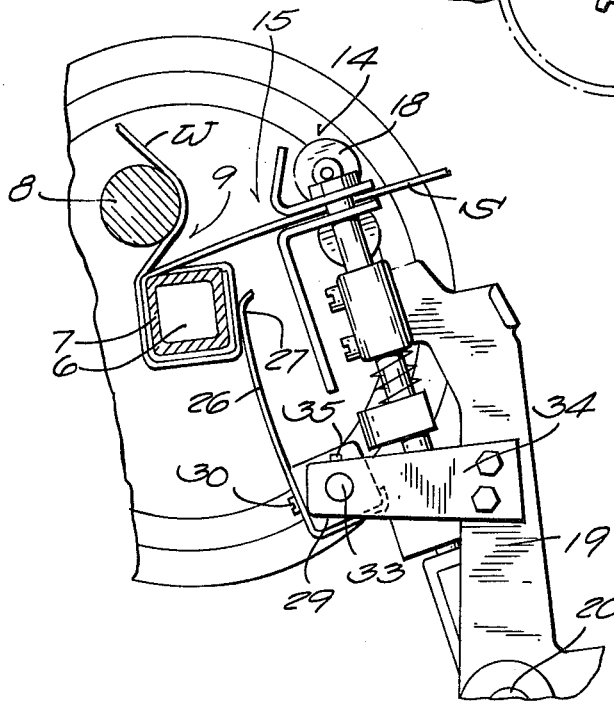
Figure 3:
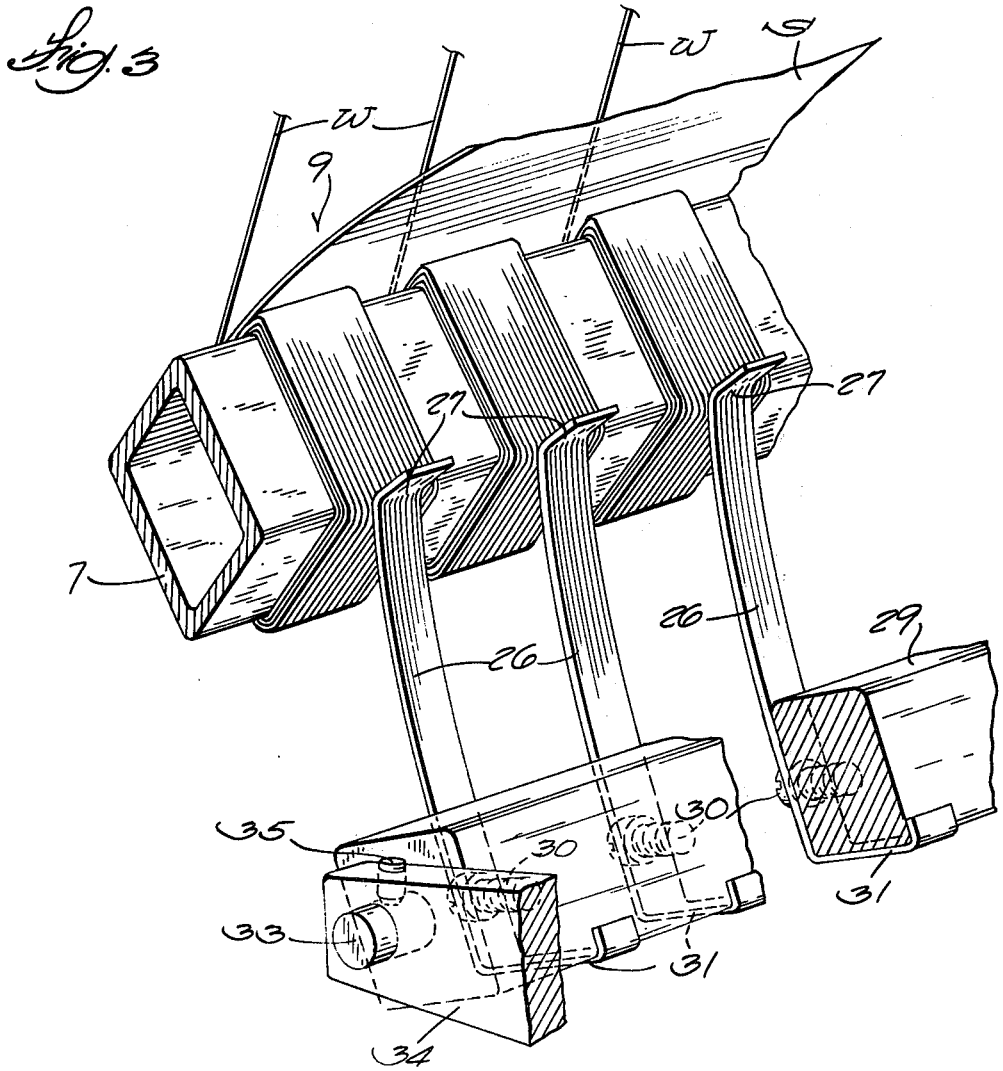

The accompanying drawings illustrate one complete example of the embodiment of the invention constructed according to the best mode so far devised for the practical application of the principles thereof, and in which:

FIG. 1 is a fragmentary view mainly in side elevation, of an automatic coil winding machine incorporating the improvement of the present invention and showing the involved parts in the positions they occupy just before a sheet of insulation is about to begin its enwrapment about the coil;

FIG. 2 is an enlargement of a portion of FIG. 1 showing the resilient fingers of this invention in their operative position pressing the insulation sheet against a just-wound layer of turns; and FIG. 3 is a fragmentary perspective view of a group of the fingers in their operative positions pressing a sheet of insulation against the just completed layer of turns of a number of coils in the process of being wound, and also illustrating part of the structure by which the fingers are mounted in the winding machine.

Referring to the accompanying drawings, the numeral 5 designates generally a coil winding machine like the one disclosed in the aforesaid Bell U.S. Pat. No. 2,688,450. The machine is herein illustrated and described only to the extent necessary for an understanding of the present invention, inasmuch as the Bell patent can be consulted for a more detailed description of the machine itself, and particularly of its mechanism for emplacing insulation sheets.

As explained in the U.S. Pat. No. 2,688,450 Bell patent, the machine 5 comprises means (not shown) for rotatably mounting a winding mandrel or arbor 6 and for rotating it about a fixed axis. The mandrel has provision for having a tubular coil form 7 detachably mounted thereon and rotated thereby.

Although a coil form of substantially square cross section is illustrated, it will be understood that the invention is also useful when coils are wound onto forms of circular cross section. In general, it has heretofore been more difficult to secure snug insulation wrappings with square-section coil forms, because the insulation material tends to maintain a uniform radius curvature and therefore tries to spring away from the flat surfaces of a non-circular coil form.

Usually the coil form is rather long, so that—as seen in FIG. 3—a number of coils can be wound onto it simultaneously. For each coil to be wound, a strand of wire W extends from a wire source which is not shown but which conventionally comprises a spool or bobbin that is located at some distance from the mandrel 6 and is confined to more or less free rotation about a fixed axis.

At the beginning of a winding operation, each strand of wire W is connected to a coil form 7 that has been mounted on the mandrel 6, the several wire strands being spaced apart at uniform intervals along the coil form.

Although the attachment of the wires to the coil form can be effected in any suitable way, it is usually done by soldering the wires to a thin metal foil strip fixed to and extending lengthwise along one side of the coil form. With all of the wire strands attached to the coil form, the mandrel is steadily rotated to draw wire from the sources and wind it into coils on the coil form. Normally, rotation of the mandrel continues uninterruptedly until the coils are fully wound.

Each strand of wire passes over a wire guide 8 that slowly reciprocates along a path parallel to the mandrel axis. In a known manner, reciprocation of the wire guides is so timed in relation to the rate of rotation of the mandrel 6 that the wires are applied to the coil form 7 in smooth layers that overlie one another. The points of tangency between the coils and all of the wires always lie in a straight row that is parallel to the mandrel axis, so that the several stretches of wire which extend from the wire guides 8 to the coils lie in a plane which together with the upwardly facing surface of the coils form a V-shaped pick-up zone 9.

When the winding of each layer of every coil being wound is completed, and just as the wire guides 8 reverse their direction of reciprocation, a sheet S of paper or paper-like insulation material is automatically fed into the pick-up zone 9 to have its leading edge gripped between the just-wound wire layer and the wires leading thereto. As a result, the insulation sheet is wound onto the coils along with the wires that are to overlie the sheet and form the beginning of a new coil layer.

The insulation material is supplied in the form of a roll (not shown) mounted for substantially free rotation on a fixed axis spaced a substantial distance from the mandrel 6. Cooperating feed rollers 11 and 12, located a distance behind the mandrel draw a web of the material from the roll and advance it forwardly to a delivery element 14 that swings back and forth between the feed rollers and the mandrel. The delivery element comprises cooperating clamping bars 15 by which insulation sheets of a size determined by the operation of a measuring bar 16 and cut from the web by a cutter 17, are releasably gripped and fed into the pickup zone 9.

The manner in which the feed rollers 11 and 12, the cutter 17 and the delivery element 14 perform their functions in synchronized relation to one another and to the wire guides 8 is fully described in the aforesaid U.S. Pat. No. 2,688,450, but the following rather general description may obviate reference to that patent.

Shortly before a sheet is to be presented to the pickup zone, the delivery element 14 is in its rearmost position with its cooperating clamping bars 15 separated. The feed rollers 11 and 12 feed the leading end of the web of insulation material forwardly into the bite of the clamping bars, and when the web has advanced far enough to project a predetermined distance ahead of the delivery element, the clamping bars close onto it to prevent its further advance relative to the delivery element. However, the feed rollers continue to feed a predetermined additional length of the web, which is pulled down into a loop between the feed rollers and the delivery element by the measuring bar 16, whereupon the cutter 17 is actuated. The size of the loop determines the length of the sheet that is severed from the web by the cutter and is determined by the distance the measuring bar moves, and that distance is governed by the prevailing diameter of the coils being wound.

After the sheet is severed from the web, the delivery element 14, with the sheet in its grasp, is swung forwardly a distance that delivers the projecting front edge of the sheet into the pickup zone. When the delivery element completes that forward swing, the clamping bars 15 separate and release their grip on the sheet, which allows the sheet to be drawn onto and wound about the coils along with the strands of wire that are being wound into new coil layers.

When the clamping bars separate, the sheet is confined between opposed, freely rotatable guide rollers 18 on the delivery element, which rollers afford a certain amount of guidance to the sheet as it is being wound into the coils, to prevent the sheet from skewing, buckling or wrinkling. The delivery element remains in its forward sheet-emplacing position at least until the sheet is completely wound onto the coil form; and then it moves back to its sheet receiving position in ample time to execute sheet emplacing operation upon the next reversal in direction of reciprocation of the wire guides.

The delivery element 14 is carried by a pair of generally upright arms 19, the upper ends of which have the clamping bars 15 and the guide rollers 18 mounted thereon. At their lower ends, the arms are fixed to an elongated rock shaft 20 that extends across the machine and is parallel to the axis of the mandrel 6, so that the arms 19 can swing in unison towards and from the mandrel to provide the back and forth motion of the delivery element. As explained in U.S. Pat. No. 2,668,450, the rock shaft 20 is journaled in the outer ends of a pair of arms 21 that swing up and down about a fixed axis so that the rock shaft—and thus also the delivery element—are moved upwardly in small increments during the winding of a stick of coils, to accommodate the progressive increase in coil diameter and ensure that each sheet will be carried across the top of the coils.

In accordance with the present invention, the delivery element 14 carries a series of resilient fingers 26, each of which has an anchored end and a free end, the latter having a localized contact surface portion 27 that is engaged under bias against the rotating coil form, or—more accurately—against the coils thereon, when the delivery element is in its forward sheet-emplacing position. As seen in FIG. 3, the fingers are spaced apart lengthwise of the coil form and are located to contact the coils being wound thereon at points substantially diametrically opposite the pick-up zone 9.

As a sheet of insulation is wound onto the rotating coils along with the wire strands W in the known manner, the coil form makes about one-half a revolution before the sheet comes under the surfaces 27 on the fingers 26. By virtue of the biased condition of the fingers, their contact surface portions press the sheet radially inwardly into firm engagement with the coils and exert a slight drag on the sheet in the circumferential direction, thereby ensuring a tight enwrapment of the sheet. Because the fingers do not engage the sheet until it has been drawn about half way around the coils, the fingers do not interfere with the sheet being wound onto the coils; but they do take up slack in the sheet and press it against the just completed layer of turns. This assures the desired tight placement of the insulation between successive layers of turns.

As shown in FIG. 3, each of the fingers 26 can comprise an elongated substantially upright leaf spring that is anchored to a bar 29 at its lower end. Near its upper and each finger has a small rearwardly curved convex surface which provides its localized contact surface portion 27, which, of course, faces the coil form.

The bar 29 that carries the fingers 26 is preferably of rectangular cross section and is carried by the upright arms 19 of the delivery element, to which it is secured at its opposite ends. As illustrated, each finger 26 is secured to the front face of the bar 29 by means of a single machine screw 30 that extends through the finger and is threaded into the bar. The lower end portion of each finger is bent back at right angles to the main length thereof, to form a flange 31 that engages under the bottom surface of the bar and prevents the finger from rotating edgewise about the machine screw 30.

The bar 29 is preferably adjustably rotatable about its axis, to provide for adjustment of the biasing force which the fingers exert against the coils, and for that purpose the end portions of the bar are formed as coaxial round pins 33 that are received in bored supporting brackets 34, one anchored to each of the arms 19. A set screw 35 in each bracket 34 bears against the pin 33 therein to secure the bar in its selected position of rotation.

The mechanism that actuates the delivery element in timed relation to the wire guides and to the other parts of the sheet feeding instrumentalities, causes the delivery element to remain in its forward sheet-emplacing position during the time it takes for the sheet delivered thereby to be completely wrapped around the coils, and consequently the fingers 26 remain in their operative positions of engagement with the coils long enough to assure that the entire trailing portion of the sheet will be held against the just-laid wire layer. That mechanism also holds the delivery element in its rearward sheet-receiving position during the times when a wound coil form—i.e. a "stick of coils"—is being removed from the mandrel and a new coil form installed thereon, and consequently the fingers 26 are at such times in an inoperative position, spaced well away from the mandrel axis and presenting no inconvenience to the machine attendant.

The operation of the sheet holding finger mechanism is entirely automatic, is a function of the conventional operation of the delivery element, and requires no modification of the timing and actuating mechanism for the delivery element. In fact, to incorporate the present invention into an existing automatic coil winding machine, it is only necessary to slightly rework the arms 19 of the delivery element to provide for the attachment of one of the bar supporting brackets 34 to each arm.

From the foregoing description taken with the accompanying drawings, it will be apparent that the present invention provides an improvement in an automatic coil winding machine having mechanism for placing insulation sheets between coil layers, whereby such sheets are snugly and tightly wrapped to ensure than the wound coils will be firm and stable; and it will also be apparent that the improvement takes the form of simple structure capable of being readily installed on any existing machine without requiring significant reworking of any part thereof.

Those skilled in the art will appreciate that the invention can be embodied in forms other than as herein disclosed for purposes of illustration.

The invention is defined by the following claims.

We claim:

1. A coil winding machine having mandrel means rotatable about a fixed axis and on which a coil form can be coaxially supported for rotation therewith, wire guide means by which wire from a source thereof is guided onto a rotating coil form on said mandrel means and/or onto a just-laid layer of a multi-layer coil being wound thereon, said wire guide means being so located with respect to the axis of the mandrel means that the stretch of wire leading from the wire guide means to the coil form or said just-laid wire layer is tangentially disposed with respect thereto, whereby said stretch of wire and said just-laid wire layer coact to define a pickup zone, and sheet inserting means operative at the conclusion of the winding of each layer of the coil to feed a sheet of insulation material edgewise into said pickup zone to be gripped between said stretch of wire and the just-laid layer of wire simultaneously with the start of the next layer to be wound, said coil winding machine being characterized by:

means for ensuring that each sheet of insulation material is tightly wrapped, so that a coil wound on the machine will be compact, firm and stable, said means comprising:

A. a resilient finger having an anchored end and a free end portion;

B. carrier means for the resilient finger;

C. means securing the anchored end of the finger to said carrier means;

D. means movably mounting said carrier means for movement thereof in opposite directions transverse to the axis of the mandrel means between defined operative and inoperative positions, in both of which a coil form on the mandrel means lies between the wire guide means and the resilient finger, so that the latter does not interfere with progression of said stretch of wire along the length of the coil form during the winding of the successive layers of the multi-layer coil, in the inoperative one of said positions, no part of the resilient finger contacts the coil form or any part of a coil thereon, and in the operative one of said positions the free end portion of the resilient finger bears against the coil form at a location spaced circumferentially from the point of tangency between said stretch of wire and the just-laid layer of wire, and also spaced from the path along which the sheet of insulation material is fed into said pickup zone, whereby said sheet is engaged by the free end portion of the resilient finger as it is wrapped about the just-laid layer of wire to assure that said sheet will be tightly wrapped about said just-laid wire layer; and E. means for moving said carrier means from one to the other of its defined positions in timed relation with the operation of said sheet inserting means, and for holding said carrier means in its operative position with the resilient finger in engagement with the sheet of insulation material throughout substantially the entire enwrapment thereof about the just-laid layer of wire.

2. The coil winding machine of claim 1, wherein said mandrel means accommodates a coil form that is long enough to have a plurality of multi-layer coils wound thereon in end-to-end relationship, wherein said wire guide means simultaneously feeds wire to all of the coils being wound on the coil form and moves to and fro lengthwise of the coil form as required to wind the coils in successive layers, wherein said sheet inserting means accommodates sheets of insulation material wide enough to encompass all of the coils being wound on the coil form, and wherein said sheet inserting means comprises a pair of spaced apart arms that are constrained to swing back and forth in unison about an axis that is parallel to and spaced from said fixed axis about which the mandrel means rotates, in timed relation with the to and fro movement of the wire guide means, between a sheet delivering position which they occupy during winding of a sheet of insulation material onto a just-laid layer of the coils being wound and a retracted position which they occupy at other times, and further characterized in that there is a resilient finger for each coil being wound on the coil form, and in that said carrier means comprises an elongated bar carried by and spanning the distance between said arms in substantially parallel relationship with the axis about which the arms swing, said bar having the anchored ends of all of the resilient fingers secured thereto.

3. The coil winding machine of claim 2, further characterized by means mounting said bar on said arms for adjustment relative to the arms in directions to move the free ends of the resilient fingers towards and from said fixed axis about which the mandrel means rotates, to provide for adjustment of the pressure the resilient fingers exert on the sheet of insulation material being wound onto the just-laid layer of wire of all of the coils.

* * * * *